US011056805B2

(12) United States Patent
Diop et al.

(10) Patent No.: US 11,056,805 B2
(45) Date of Patent: Jul. 6, 2021

(54) METHOD OF CONNECTING AN ELECTRICALLY CONNECTING CABLE TO A SPLICE

(71) Applicant: Hubbell Incorporated, Shelton, CT (US)

(72) Inventors: Seydou Diop, Birmingham, AL (US); Paul Zelazny, Moody, AL (US); John Edward Sakmar, Birmingham, AL (US)

(73) Assignee: Hubbell Incorporated, Shelton, CT (US)

( * ) Notice: Subject to any disclaimer, the term of this patent is extended or adjusted under 35 U.S.C. 154(b) by 30 days.

(21) Appl. No.: 16/701,904

(22) Filed: Dec. 3, 2019

(65) Prior Publication Data

US 2020/0144737 A1 May 7, 2020

Related U.S. Application Data

(63) Continuation of application No. 15/357,455, filed on Nov. 21, 2016, now Pat. No. 10,498,052, which is a continuation of application No. 14/099,052, filed on Dec. 6, 2013, now Pat. No. 9,502,791.

(60) Provisional application No. 61/894,510, filed on Oct. 23, 2013.

(51) Int. Cl.
*H01R 4/48* (2006.01)
*H01R 4/52* (2006.01)

(52) U.S. Cl.
CPC ..... *H01R 4/4872* (2013.01); *H01R 4/52* (2013.01)

(58) Field of Classification Search
CPC ..... H01R 4/4872; H01R 4/52
See application file for complete search history.

(56) References Cited

U.S. PATENT DOCUMENTS

| | | | |
|---|---|---|---|
| 69,542 | A | 5/1900 | Gerard |
| 1,997,649 | A | 4/1935 | Ohlund |
| 2,144,050 | A | 1/1938 | Fotsch |
| 2,138,913 | A | 12/1938 | Fotsch |
| 2,463,145 | A | 3/1940 | Buchanan |
| 2,199,283 | A | 4/1940 | Cook |
| 2,215,072 | A | 9/1940 | Rogoff |
| 2,217,978 | A | 10/1940 | Becker |
| 2,521,722 | A | 9/1950 | Hubbell et al. |
| 2,554,387 | A | 5/1951 | Saul |
| 2,572,940 | A | 10/1951 | Lockhart |
| 2,859,424 | A | 11/1958 | Berndt |

(Continued)

*Primary Examiner* — Carl J Arbes
(74) *Attorney, Agent, or Firm* — Michael Best & Friedrich LLP

(57) ABSTRACT

A cable splice includes a casing, a guide, and a pilot cup. The casing has a first opening and an interior cavity. The guide includes a receiving end and a shaft extending at least partially into the interior cavity. The pilot cup is integrally formed with the guide and frangibly connected to the shaft. The cable splice may also include a clamp positioned in the interior cavity and moveable between a loading position and a terminated position. A biasing member urges the clamp into the terminated position. During movement of the clamp from the loading position to the terminated position, the clamp contacts the guide causing at least a portion of the shaft to exit the interior cavity. The guide may also include a rib and a slot allowing the guide to fit in casings having different sized interior cavities.

20 Claims, 12 Drawing Sheets

(56) References Cited

U.S. PATENT DOCUMENTS

| | | | | | |
|---|---|---|---|---|---|
| 2,966,653 | A | | 12/1960 | Jugle | |
| 3,072,989 | A | | 1/1963 | Jugle et al. | |
| 3,205,300 | A | | 9/1965 | Becker | |
| 3,241,204 | A | | 3/1966 | Baricevic | |
| 3,681,512 | A | * | 8/1972 | Werner | H01R 4/08 174/84 R |
| 3,852,850 | A | | 12/1974 | Filhaber | |
| 3,912,406 | A | * | 10/1975 | McGrath | F16G 11/048 403/19 |
| 4,192,964 | A | | 3/1980 | Sacks | |
| 4,252,992 | A | | 2/1981 | Cherry et al. | |
| 4,698,031 | A | | 10/1987 | Dawson | |
| 5,015,023 | A | | 5/1991 | Hall | |
| 5,278,353 | A | * | 1/1994 | Buchholz | H01R 4/52 174/84 R |
| 5,334,056 | A | | 8/1994 | Hlinsky | |
| 5,369,849 | A | | 12/1994 | De France | |
| 5,600,096 | A | | 2/1997 | Cherry | |
| 5,683,273 | A | | 11/1997 | Garver | |
| 6,206,736 | B1 | | 3/2001 | Defrance et al. | |
| 6,773,311 | B2 | | 8/2004 | Mello et al. | |
| 7,219,399 | B2 | | 5/2007 | Tamm | |
| 7,256,348 | B1 | | 8/2007 | Endacott | |
| 7,799,996 | B2 | | 9/2010 | Tamm et al. | |
| 8,221,155 | B2 | | 7/2012 | Luzzi | |
| 8,672,699 | B2 | | 3/2014 | Gaertner | |
| 9,054,445 | B2 | | 6/2015 | O'Sullivan | |
| 9,450,316 | B2 | * | 9/2016 | Diop | H01R 4/52 |
| 2006/0108140 | A1 | | 5/2006 | Wiley | |
| 2011/0183539 | A1 | | 7/2011 | Gaertner | |
| 2012/0217062 | A1 | | 8/2012 | Cawood et al. | |
| 2013/0081852 | A1 | | 4/2013 | Cawood | |

* cited by examiner

METHOD OF CONNECTING AN ELECTRICALLY CONNECTING CABLE TO A SPLICE

CROSS-REFERENCE TO RELATED APPLICATIONS

This application is a continuation of co-pending, prior-filed U.S. application Ser. No. 15/357,455, filed Nov. 21, 2016, which is a continuation of U.S. application Ser. No. 14/099,052, filed Dec. 6, 2013, which claims the benefit of U.S. Provisional Application Ser. No. 61/894,510, filed Oct. 23, 2013. The contents of these documents are incorporated herein by reference.

FIELD OF THE INVENTION

The present invention relates generally to an automatic splice for splicing together first and second conductors.

BACKGROUND OF THE INVENTION

Splicing connectors may be used to join a variety of electrical conductors, including high-voltage power lines. Some splicing connectors allow a user to simply input two different conductors into the connector. Such splicing connectors, commonly referred to as automatic splices, may be used by utility linemen to quickly connect lengths of suspended cable during installation or repair of downed power lines.

An automatic splice typically includes a housing having an opening on each axial end for receiving cables. After the cables are inserted, the housing includes clamps for maintaining the cable in a relative position. The automatic splice is then capable of conducting electricity from one cable to the other. Seating the cables properly in the housing is important to ensure a secure and lasting connection. This seating is especially true in exposed cables undergoing stress from different directions, such as from wind, ice, galloping or additional loading that may occur in regular use.

Utility linemen use automatic splices in normal or emergency power restoration situations, under a variety situations and environmental conditions. Applying significant force to insert the cables or knowing if the cable has been fully inserted may be difficult for the lineman. Automatic splices are also typically solid, making visual inspection of the cables positioning impossible. If a cable is not properly or fully inserted, the retaining clamps will not function as intended. Failure of a spliced connection can release live cables, risking dangerous conditions to people and property, especially in the instance of live power lines.

SUMMARY OF THE INVENTION

In accordance with an embodiment, a cable splice includes a casing, a guide, and a pilot cup. The casing has a first opening and an interior cavity. The guide includes a receiving end and a shaft extending at least partially into the interior cavity. The pilot cup is integrally formed with the guide and frangibly connected to the shaft.

In accordance with a further embodiment, a cable splice includes a casing, a guide, a jaw, and a biasing member. The casing has an opening and an interior cavity. The guide includes a receiving end and a shaft extending at least partially into the interior cavity. The jaw is positioned in the interior cavity and moveable between a loading position and a terminated position. The biasing member urges the jaw into the terminated position. During movement of the jaw from the loading position to the terminated position, the jaw contacts the guide, causing at least a portion of the shaft to exit the interior cavity.

In accordance with another embodiment, a cable splice includes a casing and a guide. The casing has a first opening and an interior cavity. The guide includes a receiving end, a shaft extending at least partially into the interior cavity, a rib, and a slot. The rib and the slot allow the guide to fit in casings having different sized interior cavities.

Other embodiments, including apparatus, systems, methods, and the like which constitute part of the invention, will become more apparent upon reading the following detailed description of the exemplary embodiments and viewing the drawings. It is to be understood that both the foregoing general description and the following detailed description are exemplary and explanatory only and therefore not restrictive.

BRIEF DESCRIPTION OF THE DRAWINGS

The accompanying drawings are incorporated in and constitute a part of the specification. The drawings, together with the general description given above and the detailed description of an exemplary embodiment given below, serve to explain the principles of the invention. In such drawings.

DETAILED DESCRIPTION OF THE INVENTION

Figure 1:
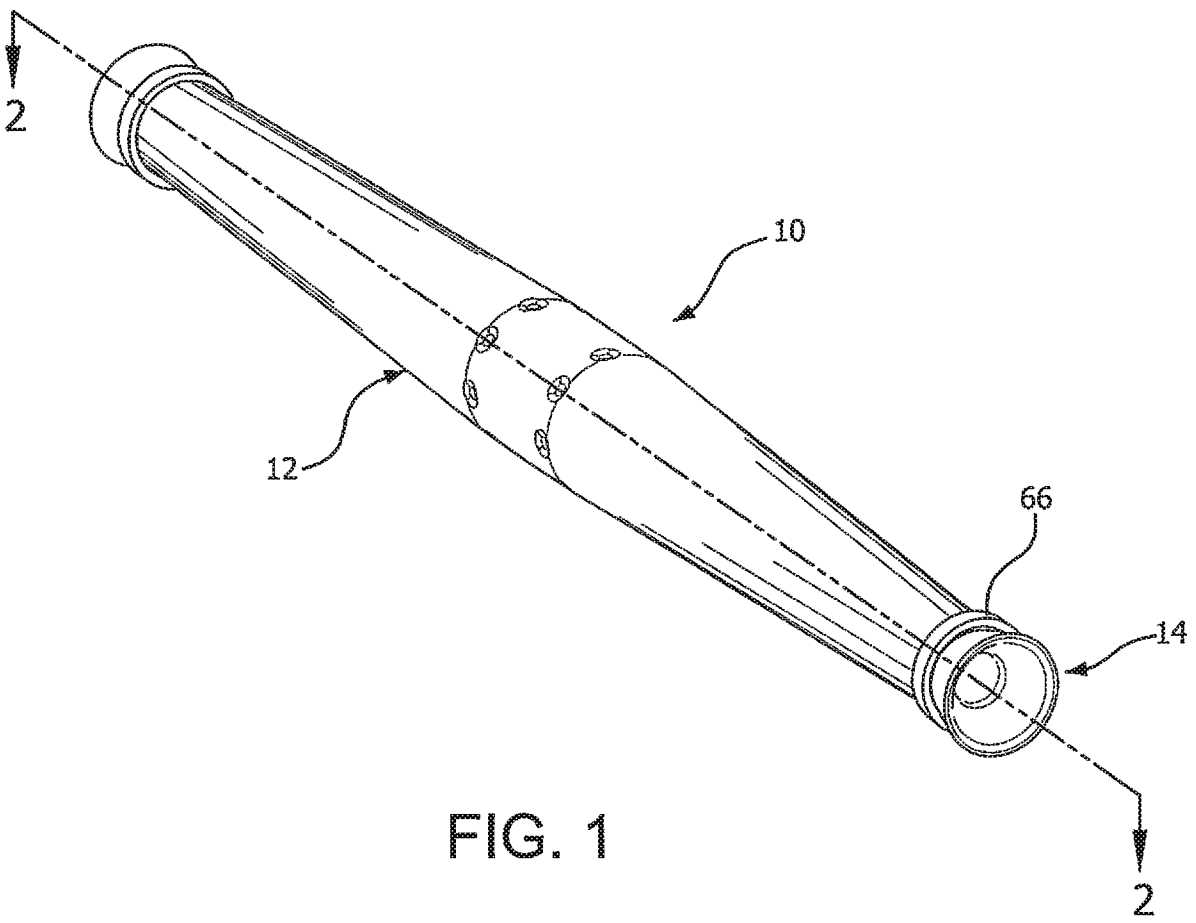
FIG. 1 is a perspective view of a cable splice according to an exemplary embodiment of the invention.

An automatic splice 10 in accordance with an exemplary embodiment of the invention includes a casing 12, a guide 14, a pilot cup 16, a clamp 18 in the form of a jaw assembly, a biasing member 20, and a center stop 22. The casing 12 includes a substantially tubular body 24 having a first casing end 26 and, a second casing end 28 tapering from a cylindrical central region 30, and having an internal cavity 32. The internal cavity may also be divided into a tapered first chamber 34, a tapered second chamber 36, and a cylindrical central chamber 38. One guide 14, one pilot cup 16, and clamp 18 are in each of the first and second chambers 34, 36. Biasing member 20, and center stop 22 are positioned in the central chamber 38.

Figure 2:
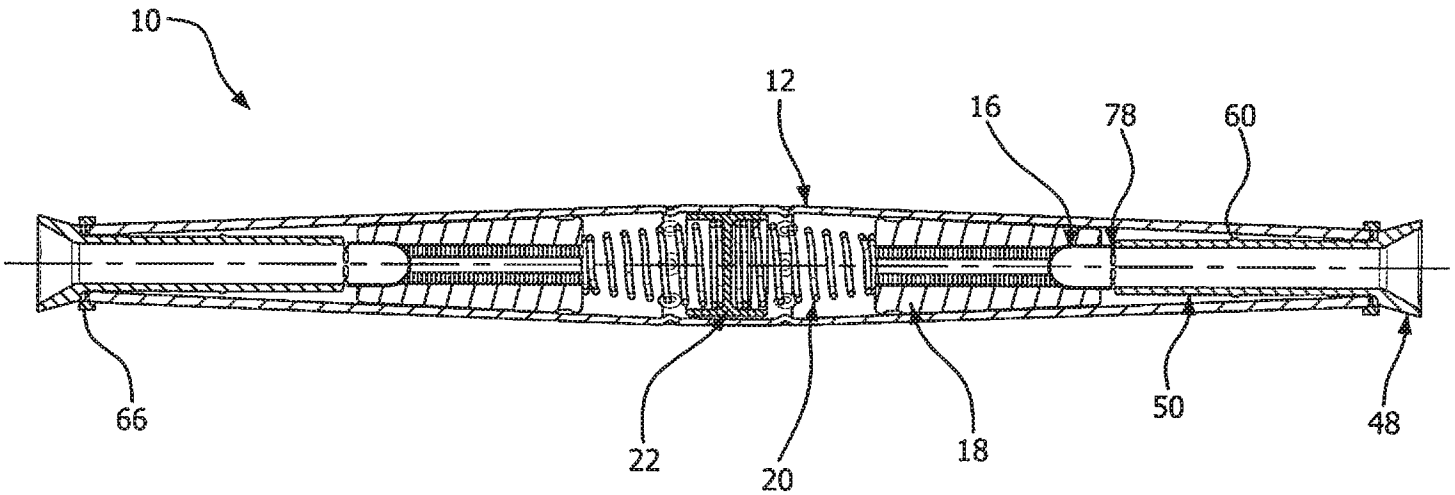
FIG. 2 is a side elevational view in section of the cable splice shown in FIG. 1.

As shown in FIG. 2, the components in the second chamber 36 may be identical to the first. Certain embodiments, however, may utilize different components in the second chamber 36. The present invention may also be utilized as a dead-end type connector that has only a single chamber as discussed in further detail with respect to FIG. 19. Although the Figures depict the first and second chambers 34, 36 having identical components, only the components of the first chamber 34 may be discussed in certain instances.

Figure 3:
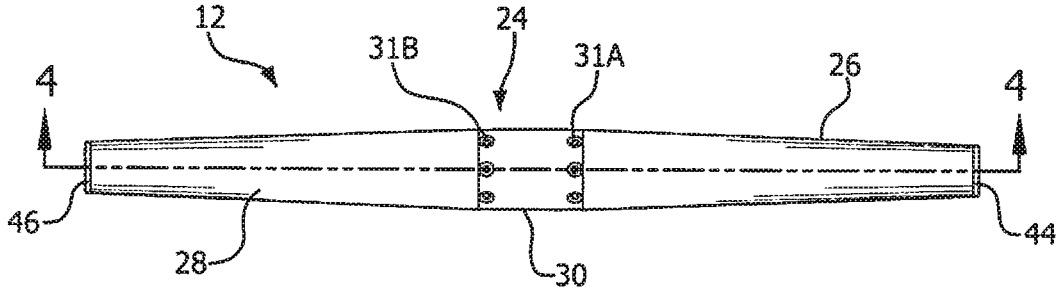
FIG. 3 is a side elevational view in elevational view of the casing of the cable splice of FIG. 1.
Figure 4:
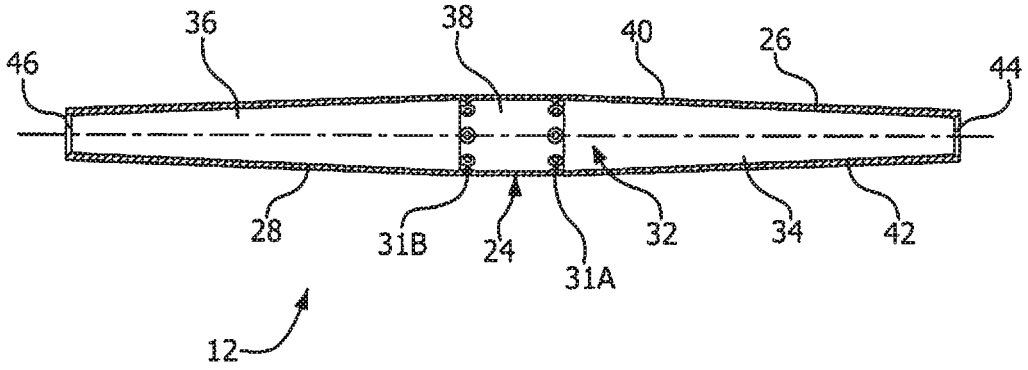
FIG. 4 is a side elevational view in section of the casing shown in FIG. 3.

As best shown in FIGS. 3 and 4, the exemplary casing 12 includes the tubular body 24, though a variety of shapes may be used including polygons having any number of straight or curved sides. The casing 12 includes an outer casing surface 40, an inner casing surface 42, a first casing aperture 44 and a second casing aperture 46. In this exemplary embodiment, the first casing end 26 tapers from the central region 30 to the first casing aperture 44, forming a frustoconical member. The central region 30 includes a first set of dimples 31A and a second set of dimples 31B. The first and second sets of dimples 31A, 31B retain the center stop 22. The first and second casing apertures 44, 46 may include a chamfered or beveled edge to allow for easy installation of additional components, for example, the guide 14 and pilot cup 16.

As best shown in FIGS. 5-8, an exemplary embodiment utilizes an integral guide 14 and pilot cup 16 that is inserted into the casing 12 through the first casing aperture 44. After insertion, the guide 14 and pilot cup 16 may be fixed or linearly moveable within the first chamber 34. The guide 14 receives and guides a cable being inserted into the automatic splice 10. The guide 14 helps prevent strands of the cable from splaying, allowing a quick, easy, and clean insertion of a length of cable.

The guide 14 includes a receiving end 48 and a cylindrical shaft 50 extending from the receiving end 48. The receiving end is shown having a funnel-shaped body 52 surrounding a guide aperture 54. As best shown in FIGS. 1 and 2, the funnel-shaped body 52 is positioned outside of the casing 12, while the shaft 50 extends into the first chamber 34. In alternative exemplary embodiments, the receiving end 48 and the shaft 50 may also be positioned either partly or entirely, in the first chamber 34. The receiving end 48 may also be variety of shapes and sizes, depending on relevant factors such as the cable shape and size. The guide may arcuately transition between the receiving end 48 and the shaft 50.

The guide 14 includes one or more ribs 56 and one or more slots 58. The ribs 56 extend outwardly from the shaft 50 as well as axially along the shaft 50. The ribs 56 have a first end adjacent the receiving end 48 and a second end positioned distally along the shaft 50. The second end of the ribs 56 may include a chamfered, tapered, or beveled surface to ease insertion of the guide 14. The slot 58 extends axially along the shaft 50 having a first end adjacent the receiving end 48 and a second end positioned distally along the shaft 50. The slot 58 may extend partially into the shaft 50 or entirely through the shaft 50. The number and position of ribs 56 and slots 58 may vary. In the exemplary embodiment shown in FIG. 6, four ribs 56 are arrayed around the shaft 50 while a single slot is provided.

The ribs 56 and slot 58 allow the guide 14 to be placed into casings 12 having different inner diameters. The ribs 56 engage the inner casing surface 42 providing a secure fit between the casing 12 and the guide 14, retaining the guide 14 in position and preventing unwanted movement relative to the casing 12. The slot 58 allows for a certain amount of compression of the shaft 50, allowing the guide 14 to fit into casings 12 having smaller inner diameters.

Figure 5:
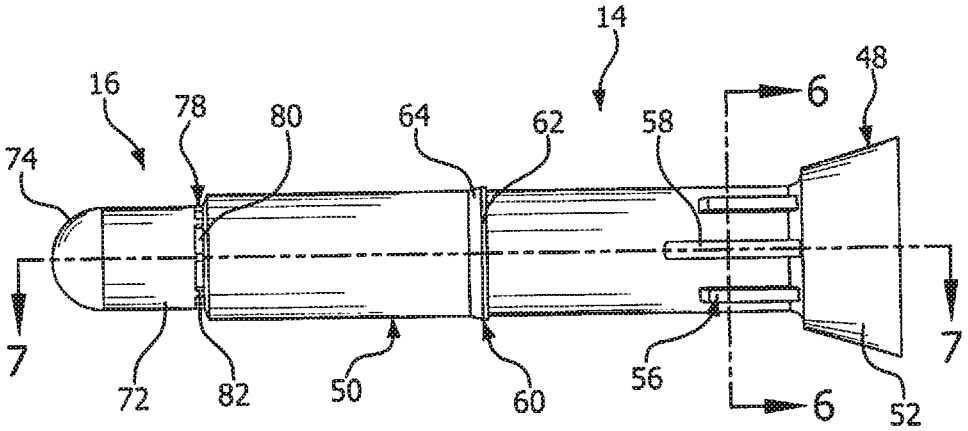
FIG. 5 is a side elevational view of the guide and pilot cup of the cable splice of FIG. 1.
Figure 6:
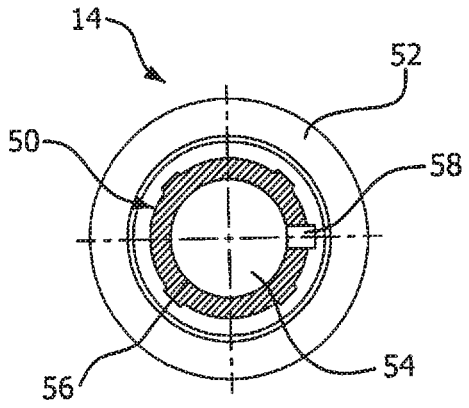
FIG. 6 is an end elevational view in section view of the guide and pilot cup of FIG. 5 taken along line 6-6 of FIG. 5.
Figure 7:
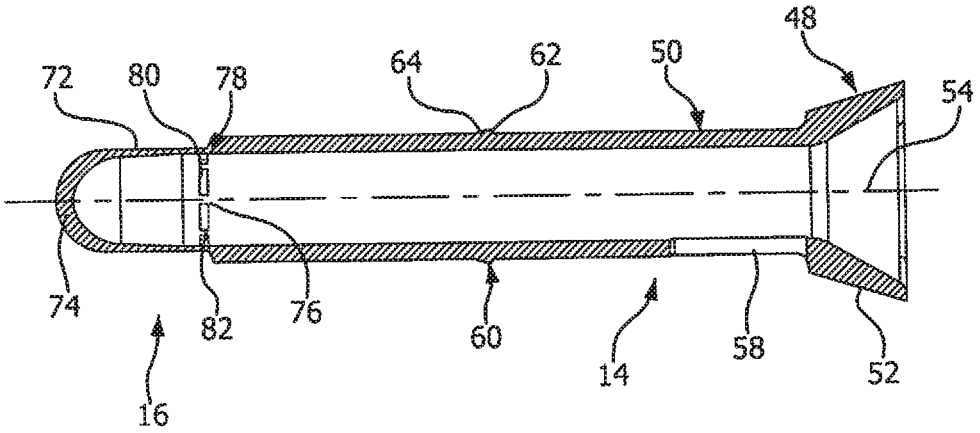
FIG. 7 is a side view in section of the guide and pilot cup of FIG. 5 taken along line 7-7 of FIG. 5.
Figure 8:
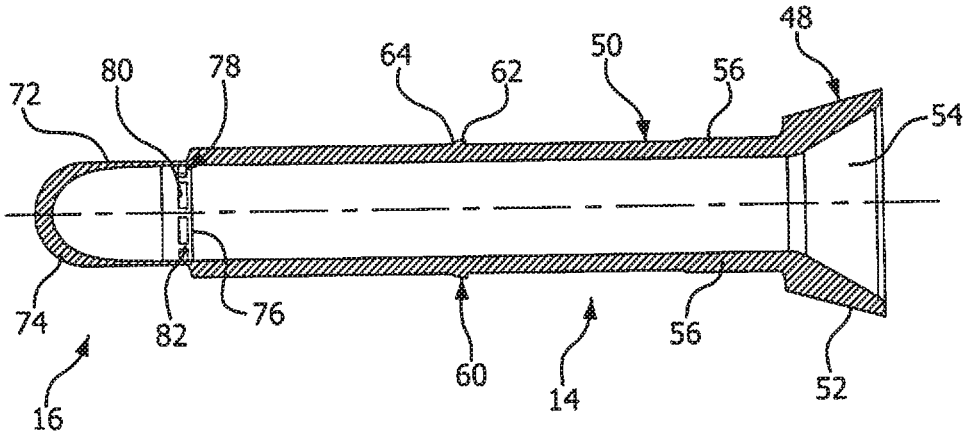
FIG. 8 is a side view in section of the guide and pilot cup of FIG. 5 taken along line 7-7 and rotated to show the rib feature.

The guide 14 also includes a stop 60 positioned on the shaft. As best shown in FIGS. 5, 7, and 8, the stop 60 may be an annular projection encircling and extending from the shaft 50. The stop 60 need not entirely encircle the shaft 50, and may include a single projection of a determined length or arc, as well as multiple discrete projections. The stop 60 may have different shapes and sizes, including various arcuate and planar surfaces. In the exemplary embodiment shown, the stop 60 has a substantially frustoconical shape with a right-trapezoidal shape in transverse cross-section with a front stop surface 62 and an angled rear wall 64. This allows the stop 60 to easily pass along the inner casing surface 42 during insertion of the guide 14 into the casing 12, but assist in preventing the guide 14 from subsequently exiting the casing 12. The stop 60 may impede the withdrawal of the guide 14 from the casing 12 by friction engagement with the tapered inner casing surface 42 at a certain point, or the inner casing surface 42 may be provided with a corresponding projection or tab to engage the front stop surface 62.

Optionally, an identification ring 66 may be included on the automatic splice 10. The identification ring 66 may be positioned adjacent the receiving end 48 of the guide 14. The identification ring 66 may be integral with the guide 14 or it may be a separate component that is attached to the guide 14, for example, by sliding the identification ring 66 over the shaft 50. As best shown in FIGS. 1 and 2, the identification ring 66 is positioned outside of the casing 12. The identification ring 66 may use markings or be colored as well as pattern coded to identify the size and type of cables or conductors that are spliced together. For example, if different sized cables are spliced together, the identification rings 66 on either end of the casing may have a different color.

Figure 9:
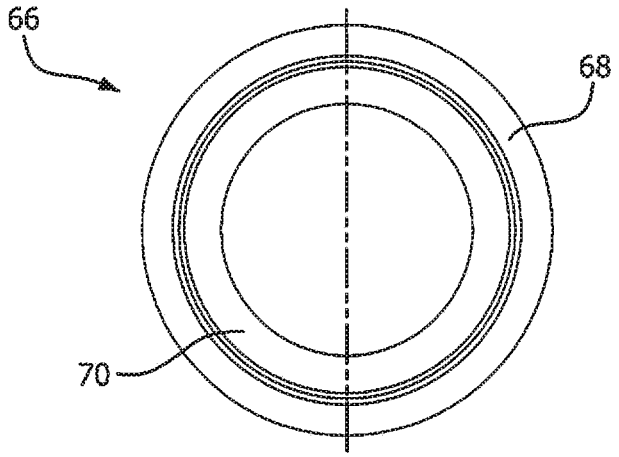
FIG. 9 is a front elevational view of an identification ring of the cable splice of FIG. 1.
Figure 10:
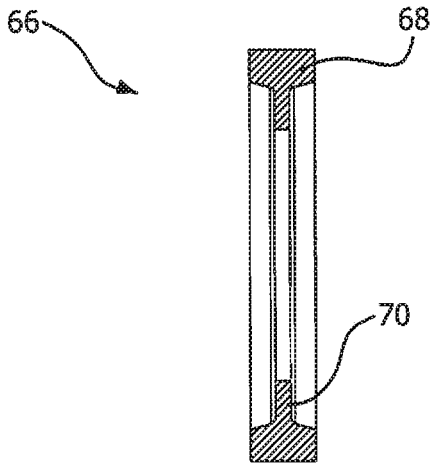
FIG. 10 is a side elevational view in section of the identification ring of FIG. 9.

As best shown in FIGS. 9 and 10, the identification ring 66 includes an outer ring 68 and a connected or integral inner ring 70. The outer ring 68 has a diameter and thickness greater than the inner ring 70. This allows the identification ring 66 to securely nest with the funnel-shaped body 52 of the guide 14 on one side and the casing 12 on the opposite side.

As best shown in FIGS. 5-8, the pilot cup 16 extends from the shaft 50 of the guide member 14. The pilot cup 16 has a pilot stem 72 and a pilot nose 74. The pilot stem 72 may have any desired shape, such as the substantially cylindrical shape shown in FIGS. 5, 7, and 8. The pilot nose 74 may also have a variety of shapes. In an exemplary embodiment, the pilot cup has a substantially hemispherical outer surface and a parabolid inner surface as shown in FIGS. 7 and 8. The pilot stem 72 and pilot nose 74 define a pilot aperture 76 for receiving a cable inserted into the guide 14.

In the exemplary embodiment, the pilot cup 16 is formed unitarily as one piece with the guide 14 and is formed of the same material as the guide 14. The pilot cup 16 is coupled to the guide 14 through a frangible connection 78. The frangible connection 78 is formed by various perforations or openings 80 alternating with projections 82. The number, spacing, and size of both the openings 80 and the projections 82 can be altered to vary the amount of force needed to separate the pilot cup 16 from the guide 14. The thickness of the pilot cup 16 may increase as it transitions from the beginning of the pilot stem 72 to the end of the pilot nose 74 to allow for the frangible connection 78 but preventing cracking, blow-out, or other damage to the pilot cup 16 as a cable is inserted and the pilot cup 16 is separated from the guide 14.

Figure 11:
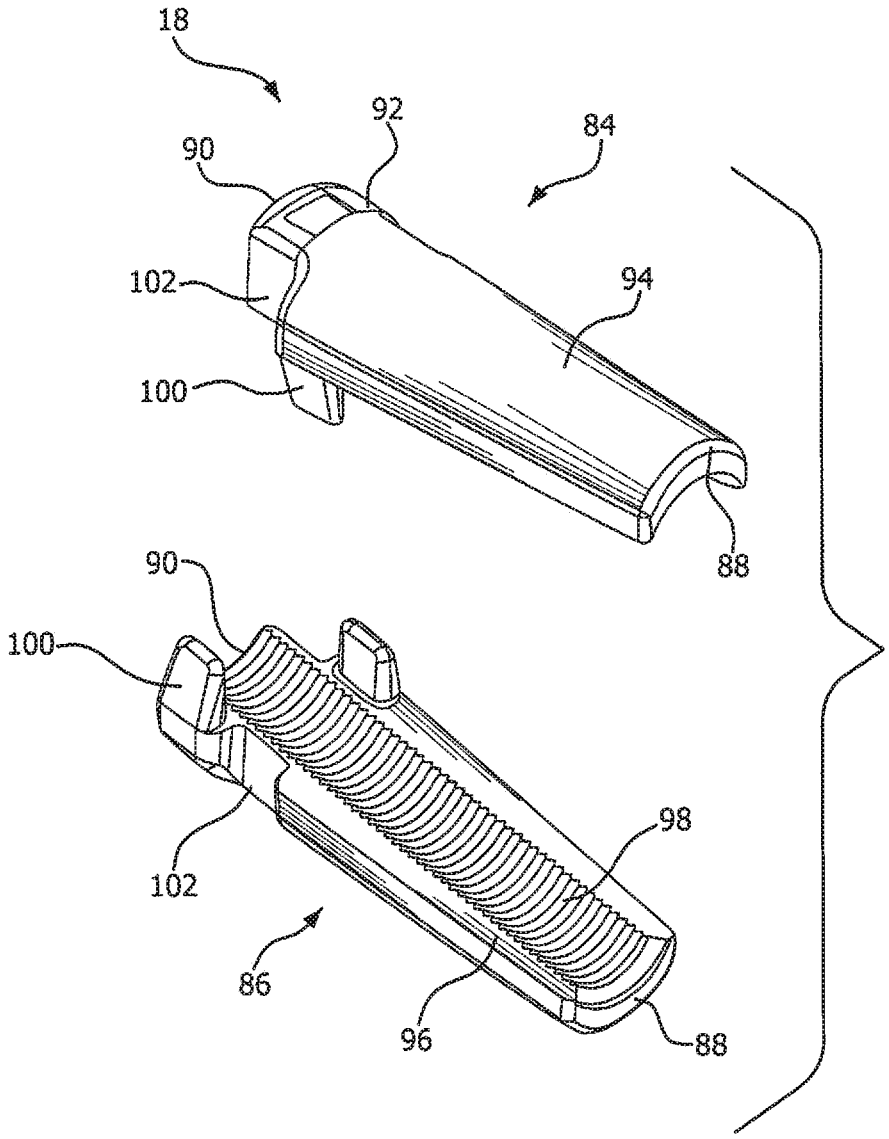
FIG. 11 is a perspective view of the jaw assembly having upper and lower jaw members of the cable splice of FIG. 1.
Figure 12:
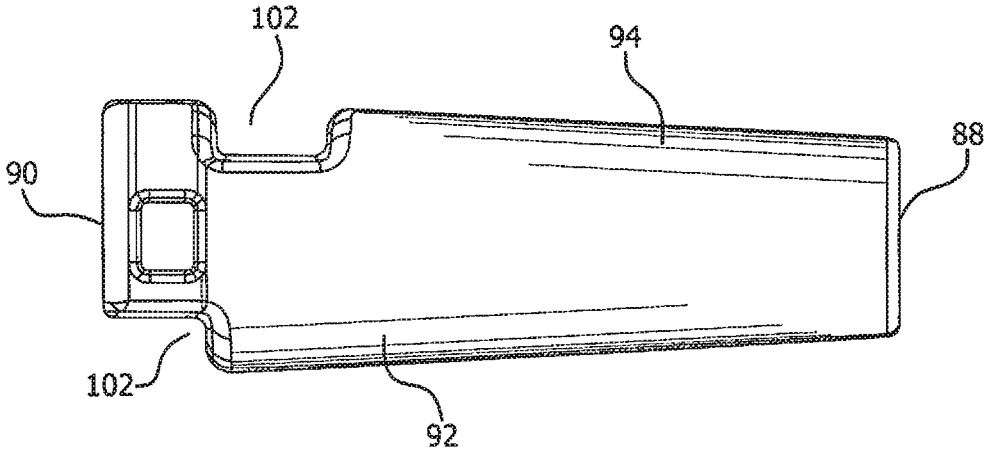
FIG. 12 is a top plan view of the upper jaw member of FIG. 11.
Figure 13:
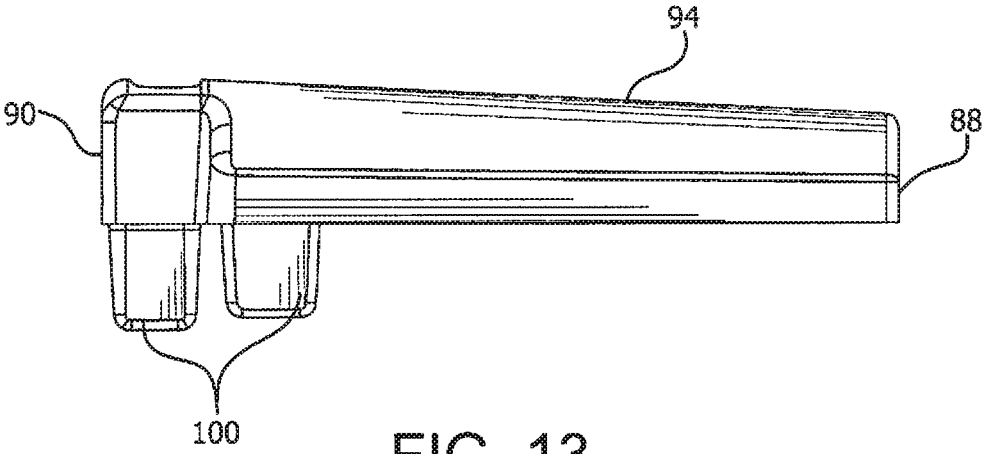
FIG. 13 is a side elevational view of the upper jaw member of FIG. 11.

The clamp 18 is positioned between the guide 14 and the biasing member 20. As best shown in FIGS. 11-13, the clamp 18 includes an upper jaw member 84 and a lower jaw member 86. Though only two jaw members 84, 86 are shown in this exemplary embodiment, one jaw member or more than two jaw members may also be used. Certain embodiments may utilize other cable retainers, instead of, or in combination with, the jaw members 84, 86, as would be understood by one of ordinary skill in the art.

The upper jaw member 84 and the lower jaw member 86 are substantially identical as shown in FIG. 11, and the same references numbers will be used for like parts in describing the jaw members 84, 86. The jaw members 84, 86 have a semi-circular cross section and a front jaw surface 88, a rear jaw surface 90, and a jaw body 92 extending therebetween. The jaw body 92 has an outer jaw surface 94 and an inner jaw surface 96. At least a portion of the jaw body 92 has a semi-funnel-shape, tapering towards the front jaw surface 88. This taper is similar to or corresponds to the taper of the inner casing surface 42, allowing the jaw members 84, 86 to slide within the first chamber 34. At least a portion of the jaw inner surface 96 contains a series of teeth 98. The teeth 98 may have any shape, pitch, length, width, or spacing. In the exemplary embodiment, the teeth 98 extend from the inner jaw surface 96 at an angle towards the rear jaw surface 90.

The jaw members 84, 86 include one or more projections 100 and one or more corresponding openings 102. The projections 100 and openings 102 may have a variety of sizes or shapes. The radially extending projections 100 and openings 102 are staggered, so that a single part may be used for the upper jaw member 84 and the lower jaw member 86. When placed together, the projections 100 from the upper jaw member 84 will mate with the openings 102 of the lower jaw member and vice versa. This mating relationship couples the upper jaw member 84 to the lower jaw member 86 to prevent one jaw member from moving axially relative to the other jaw, ensuring substantially uniform axial movement between the jaw members 84, 86. The projections 100 are extended radially inwardly and have a length preventing disengagement as the jaw members 84, 86 are moved radially away from one another by being pushed towards the central region 30, but also prevents the projections 100 from interfering with movement of the jaw members 84, 86 as they are biased towards the first casing end 26 by extending through the openings 102 and contacting the inner casing surface 42.

Figure 14:
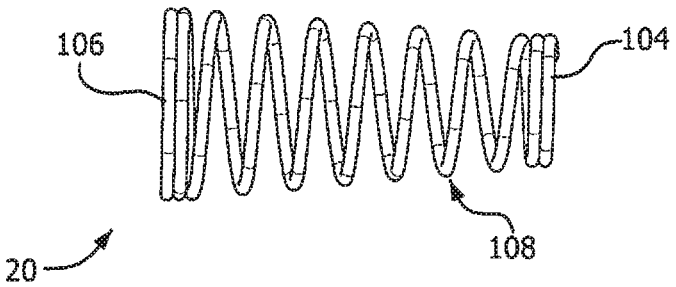
FIG. 14 is a side elevational view of biasing members of the cable splice of FIG. 1.

As best shown in FIG. 14, the biasing member 20 has a first end 104 for contacting the rear jaw surface 90 and a second end 106 for contacting the center stop 22. In the exemplary embodiment shown, the biasing member 20 is a spring 108, although the biasing member 20 may include elastomeric materials and foams. The outer diameter, wire diameter, pitch, length and material type of the spring may be varied depending on the application. The spring 108 is a helical spring that tapers from the second end 106 to the first end 104. The spring 108 need not be tapered and may also have a constant or varied pitch. For example, as best shown in FIG. 14, the spring has a substantially constant pitch except for the first and second ends 104, 106 where the last two coils have a pitch approximately equal to the wire diameter, so that the last two coils are adjacent or touching one another. This configuration increases the stiffness of the spring 108.

Figure 15:
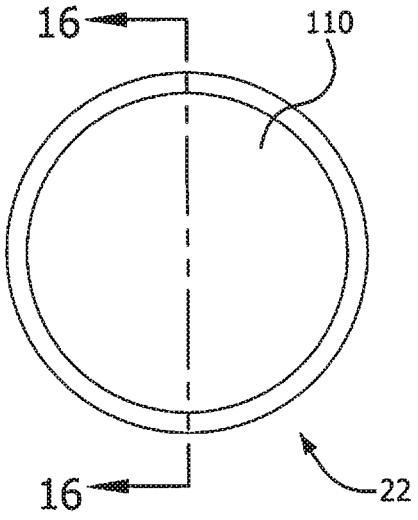
FIG. 15 is a front elevational view of the center stop of the cable splice of FIG. 1.
Figure 16:
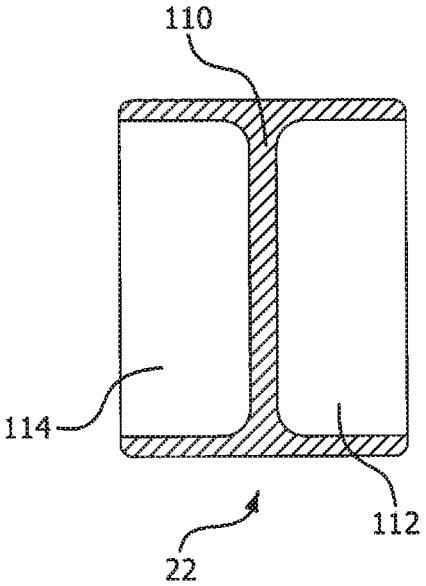
FIG. 16 is a side elevational view in section of the center stop of FIG. 15.

The center stop 22 has a center wall 110, a first opening 112, and a second opening 114. The first opening 112 receives the second end 106 of the biasing member 20 and at least partially encloses a portion of the biasing member 20. The partial enclosure helps maintain the biasing member 20 in place, preventing it from becoming dislodged and failing to exert proper biasing force in the correct direction. The center stop 22, as shown in FIGS. 15 and 16, is substantially cylindrical having corresponding cylindrical first and second openings 112, 114, although any shape, or combination of shapes, of center stop 22 and first and second openings 112, 114 may be used. The center stop 22 is held in position in the central chamber 38 by the first and second set of dimples 31A, 31B.

As best shown in FIGS. 1 and 2, in the initial position, the guide 14 extends into the first chamber 34 so that the pilot cup 16 is positioned in the jaw 18. The guide 14 receiving end 48 extends at least partially outside of the casing 12. The identification ring 66 is also positioned outside of the casing 12. The pilot cup 16 is clamped in the jaw 18, for example between the upper jaw member 84 and the lower jaw member 86. The position of the pilot cup 16 prevents the upper jaw member 84 and the lower jaw member 86 from moving closer together and prevents them from moving towards the first casing aperture 44, holding the clamp 18 open to receive a cable. In this position, the guide 14 and pilot cup 16 cause the jaw 18 to compress the biasing member 20 in a loading position.

With the automatic splice 10 in the initial, or loading, position, a first cable C1 and a second cable C2 may be loading into respective ends of the casing. Certain cables may utilize multiple strands that can spread or divert as the end of the cable is introduced into the automatic splice 10. The guide 14 receiving end 48 acts to contain the strands of the cable C1 and guide them into and through the respective first and second casing apertures 44, 46.

After passing through the guide, the cable C1 engages the pilot cup 16. The frangible connection 78 prevents the pilot cup 16 from coming dislodged from its proper, initial position. For example, the pilot cup 16 may become dislodged during storage of the automatic splice 10 and during shipment or transfer to a job site. As mentioned above, automatic splices 10 may be used in harsh environmental conditions including severe storms, and the pilot cup 16 may also become dislodged during handling of the automatic splice 10 at the job site. Moreover, even though retained in the guide 14, the strands of the cable C1 may still have tendency to splay. Splayed ends of the cable C1 may dislodge an unattached pilot cup as the cable C1 is inserted through the guide 14. With the attached pilot cup 16, these problems are avoided as the pilot cup 16 will remain in position until the cable C1 is properly seated in the pilot cup 16.

After the cable C1 fully engages the pilot cup 16, the exertion of axial pressure by a user ruptures the frangible connection 78, releasing the pilot cup 16 from the guide 14. Once the pilot cup 16 is released, the pilot cup 16 and the cable C1 may be pushed through the clamp 18. Because the pilot cup 16 is already positioned in the clamp 18, the user need not exert substantial force to open the jaw 18 and load the biasing member 20. Moreover, the clamping of the pilot cup 16 and its initial position in the clamp 18 secures the pilot cup such that it will not dislodge and rotate or tumble as it is traveling through the clamp 18, causing an early termination of the clamp 18 before the cable C1 is fully inserted. The attached pilot cup 16 and initial position in the jaw 18 will also prevent any splayed ends of the cable C1 from interfering with the jaw 18 or the biasing member 20 that would adversely affect the connection made by the automatic splice 10.

Figure 17:
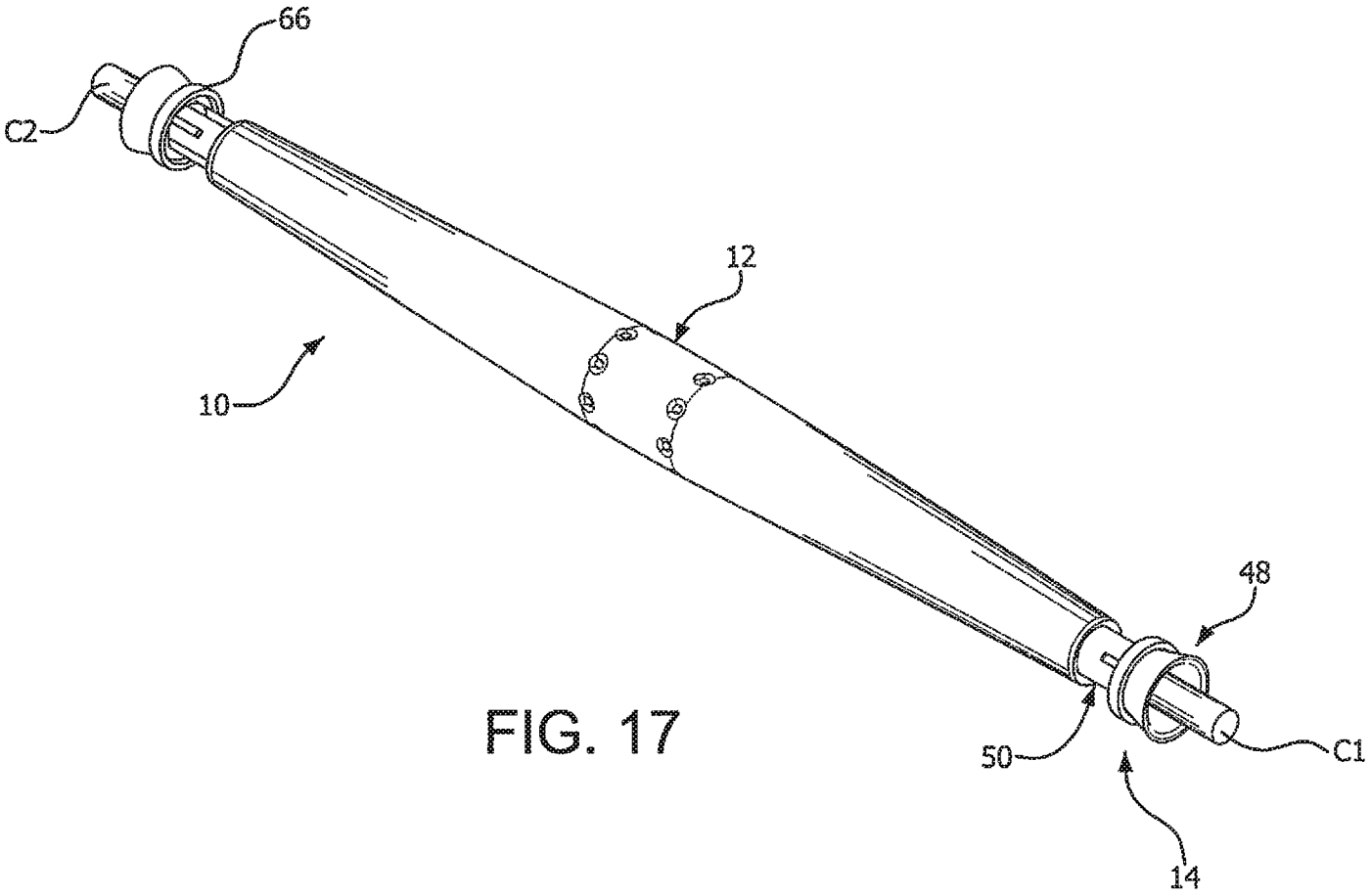
FIG. 17 is a perspective view of the cable splice of FIG. 1 after insertion of a pair of cables.
Figure 18:
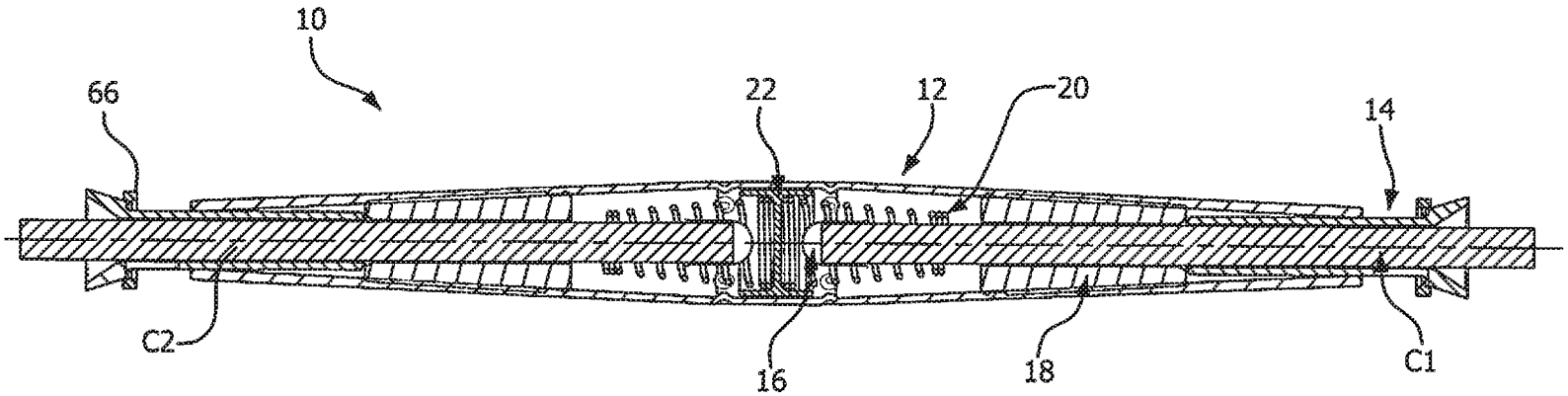
FIG. 18 is a side elevational view in section of the cable splice shown in FIG. 17.

As best shown in FIGS. 17 and 18, after the pilot cup 16 passes entirely through the clamp 18, the clamp 18 is released and the biasing member 20 provides an initial amount of force to move the clamp 18 toward the first casing aperture 44. As the clamp 18 moves forward, the tapered outer jaw surface 94 slides along the tapered inner casing surface 42, forcing the upper jaw 84 and the lower 86 radially closer to one another. The clamp 18 reaches a terminal position where it is securely clamped onto the cable C1, preventing the cable C1 from being pulled out or dislodged. The terminal position is not a set point and may vary based on the splice 10, the clamp 18, or the cable C1. As the clamp 18 clamps to the cable C1, the teeth 98 engage the cable, assisting to prevent the cable's C1 removal from the splice 10. As shown in FIG. 18, the biasing member 20 disengages the clamp 18 at a certain point, allowing the tension force from the conductor C1 to retain the clamp 18 in the terminal position. In an alternative embodiment, the biasing member 20 may continue to engage and bias the clamp 18 when it is in the terminal position.

As the clamp 18 moves forward, it will urge at least a portion of the guide 14 shaft 50 out of the casing 12. Movement of the guide 14 out of the casing 12 can indicate that the cable C1 has been properly terminated, and a user can be sure of a secure connection. The guide 14 may be provided with various indicia, such as markings or colors on the shaft 50 to make it easier for a user to tell that the cable C1 has been secured or the indicate how far the clamp 18 has traveled.

Figure 19:
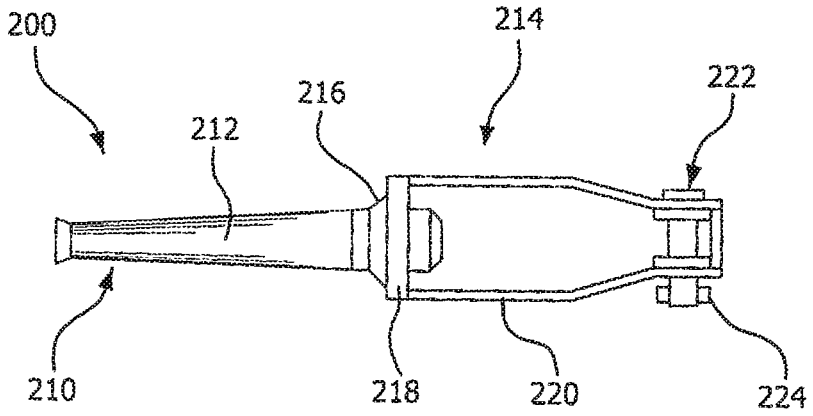
FIG. 19 is a side elevational view of a cable slide with a dead-end connector according to an exemplary embodiment of the invention.

As best shown in FIG. 19, the configuration of the automatic splice 10 may also be used in an automatic dead-end connector 200. The automatic dead-end connector 200 includes half of an automatic splice 210 having a casing 212. Although not shown, the automatic splice 210 can include any combination of the internal components of the automatic splice 10 discussed with reference to FIGS. 1-18. The casing 212 is attached to a dead end connector 214. In this exemplary embodiment a clevis-type dead end connector is used, though other types of connectors may be used as would be understood by one of ordinary skill in the art. The dead end connector 214 includes a retaining washer 216, a yoke 218, and a bail 220. A clevis pin 222 is secured to the bail 220 and retained by a cotter pin 224.

The foregoing detailed description of the exemplary embodiments has been provided for the purpose of explaining the principles of the invention and its practical application, thereby enabling others skilled in the art to understand the invention the exemplary embodiments, with various modifications as are suited to the particular use contemplated. This description is not necessarily intended to be exhaustive or to limit the invention to the precise embodiments disclosed. The embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

What is claimed is:

1. A method for electrically connecting a conducting cable to a splice, the method comprising:

positioning at least a portion of a shaft of a guide within a casing such that a cup coupled to an inner end of the shaft is positioned within a clamp, the clamp biased toward an opening of the casing;

inserting an end of the conducting cable through the guide and into the cup;

separating the cup from the inner end of the shaft by exerting pressure on the cup through the conducting cable; and after separation of the cup and the inner end of the shaft, further inserting the conducting cable through the guide to move the cup through the clamp, permitting the clamp to move toward a terminal position in which the clamp securely engages the conducting cable.

2. The method of claim 1, wherein permitting the clamp to move toward a terminal position causes the clamp to contact the inner end of the shaft and move a portion of the shaft through the opening of the casing.

3. The method of claim 2, further comprising retaining the shaft against complete removal from the casing by a stop engaging an inner surface of the casing.

4. The method of claim 1, wherein positioning at least a portion of the shaft includes positioning the cup between at least two jaw members to prevent the jaw members from moving toward the opening of the casing.

5. The method of claim 1, wherein positioning at least a portion of the shaft includes positioning the cup between at least two jaw members to prevent the jaw members from moving radially inward toward one another.

6. The method of claim 1, wherein separating the cup from the inner end of the shaft includes rupturing a frangible connection formed by a plurality of projections extending between the inner end of the shaft and the cup.

7. The method of claim 1, wherein, when the cup is positioned in the clamp, the clamp is biased toward the opening of the casing by a biasing member.

8. The method of claim 1, wherein, after the cup has moved through the clamp, the clamp is biased toward the opening of the casing by a tension in the conducting cable.

9. The method of claim 1, wherein positioning at least a portion of the shaft includes compressing a portion of the shaft to permit a portion of the shaft to pass through the opening of the casing.

10. A method for electrically connecting a conducting cable to a splice, the method comprising:

positioning at least a portion of a shaft of a guide within a casing such that a cup coupled to an inner end of the shaft is positioned within a clamp, the clamp biased toward an opening of the casing;

inserting an end of the conducting cable through the guide and into the cup;

separating the cup from the inner end of the shaft by rupturing a frangible connection between the shaft and the cup; and after separation of the cup and the inner end of the shaft, further inserting the conducting cable through the guide to move the cup through the clamp, permitting the clamp to move toward a terminal position in which the clamp securely engages the conducting cable.

11. The method of claim 10, wherein permitting the clamp to move toward a terminal position causes the clamp to contact the inner end of the shaft and move a portion of the shaft through the opening of the casing.

12. The method of claim 11, further comprising retaining the shaft against complete removal from the casing by a stop engaging an inner surface of the casing.

13. The method of claim 10, wherein positioning at least a portion of the shaft includes positioning the cup between at least two jaw members to prevent the jaw members from moving toward the opening of the casing.

14. The method of claim 10, wherein positioning at least a portion of the shaft includes positioning the cup between at least two jaw members to prevent the jaw members from moving radially inward toward one another.

15. The method of claim 10, wherein the frangible connection is formed by a plurality of projections extending between the inner end of the shaft and the cup.

16. A method for electrically connecting a conducting cable to a splice, the method comprising:

positioning a cable splice to receive a conducting cable, the cable splice including a casing having an opening and an interior cavity at least partially defined by an interior wall, a clamp positioned in the interior cavity and moveable between a loading position and a terminal position, a biasing member biasing the clamp toward the terminal position, a guide including a shaft extending through the opening of the casing and a stop extending from the shaft toward the interior wall, the shaft including a receiving end and an inner end opposite the receiving end, and a pilot cup connected to the shaft by a frangible coupling, the pilot cup holding the clamp in the loading position against a force of the biasing member;

inserting an end of the conducting cable through the guide and into the cup;

separating the cup from the inner end of the shaft by rupturing the frangible coupling between the shaft and the cup; and after separation of the cup and the inner end of the shaft, further inserting the conducting cable through the guide to move the cup through the clamp, permitting the clamp to move toward a terminal position in which the clamp securely engages the conducting cable.

17. The method of claim 16, wherein the frangible connection is formed by a plurality of projections extending between the inner end of the shaft and the cup.

18. The method of claim 16, wherein during movement of the clamp from the loading position to the terminal position, the clamp contacts the guide causing a portion of the shaft to pass through the opening.

19. The method of claim 18, wherein the stop prevents the shaft from completely exiting the interior cavity though the opening.

20. The method of claim 19, wherein the stop wherein the stop encircles the shaft.

* * * * *